US005360098A

United States Patent [19]

Nishikawa

[11] Patent Number: 5,360,098

[45] Date of Patent: Nov. 1, 1994

[54] YARN PACKAGE CONVEYING SYSTEM

[75] Inventor: Hisao Nishikawa, Kyoto, Japan

[73] Assignee: Murata Kikai Kabushiki Kaisha, Kyoto, Japan

[21] Appl. No.: 13,720

[22] Filed: Feb. 4, 1993

[30] Foreign Application Priority Data

Feb. 7, 1992 [JP] Japan ..... 4-056130

[51] Int. Cl.[5] ..... B65G 37/00

[52] U.S. Cl. ..... 198/346.1; 198/465.1; 242/35.5 A; 57/281

[58] Field of Search ..... 198/346.1, 465.1, 465.3; 242/35.5 A; 57/281

[56] References Cited

U.S. PATENT DOCUMENTS 3,527,087 9/1970 Converse et al. ..... 198/346.1
3,773,191 11/1973 Ishida ..... 242/35.5 A
4,411,354 10/1983 Thibault et al. ..... 198/465.1
4,555,067 11/1985 Angelucci et al. ..... 242/35.5 A
5,244,160 9/1993 Hinchcliffe et al. ..... 242/35.5 A

FOREIGN PATENT DOCUMENTS 2402744 8/1974 Germany ..... 242/35.5 A
379560 4/1991 Japan ..... 242/35.5 A

*Primary Examiner*—Joseph E. Valenza
*Attorney, Agent, or Firm*—Spensley Horn Jubas & Lubitz

[57] ABSTRACT

Empty trays are transferred from a main conveying line for conveying trays to a feed line branched off from the main conveying line, yarn packages are transferred one after another on the feed line from a doffing machine to the empty trays, and then the trays respectively loaded with the yarn packages are returned sequentially to the main conveying line. Thus, the yarn package conveying system curtails time necessary for transferring yarn packages form the doffing machine to the empty trays, and simplifies yarn package transferring work and the tray conveying machine.

4 Claims, 4 Drawing Sheets

YARN PACKAGE CONVEYING SYSTEM

BACKGROUND OF THE INVENTION

1. Field of the Invention

The present invention relates to a yarn package conveying system in which a plurality of empty trays are trasferred from a main conveying line conveying trays into a feed line branched from the main conveying line, yarn packages are transferred one after another from a doffing machine to the empty trays on the feed line, and the loaded trays carrying the yarn packages are returned one after another to the main conveying line.

2. Related Art Statement

A winding machine forms a plurality of yarn packages by winding yarns packages simultaneously by an automatic doffing machine and transfers the plurality of yarn packages one after another to trays. The plurality of yarn packages simultaneously doffed by the automatic doffing machine are transferred simultaneously to a peg, and then the yarn packages are trasferred one after another from the peg to trays.

Such a conventional doffing procedure has many steps of work and requires much time to transferring the yarn packages from the winder to the automatic doffing machine, to transfer the yarn packages simultaneously from the automatic doffing machine to a peg and to transfer the yarn packages one after another from the peg to the trays.

Since each package is put on the tray with a portion thereof having a yarn bunch on the rear side, the yarn package needs to be inverted in unwinding the yarn bunch, which requires an additional step of work. Furtheremore, a complicated, expensive yarn package conveying system is necessary and such a yarn package conveying system is disadvantageous in respect of effective use of the floor space of the mill.

A system proposed to overcome such disadvantages transfers yarn packages one after another from a doffing machine directly to trays. However, the yarn packages are transferred on a feed line branched off from a main conveyingline from the doffing machine to empty trays transferred from the main conveying line to the feed line owing to the layout of the system, which entails the following problems.

In the previously proposed system, one empty tray is tranferred from the main conveying line to the feed line, a yarn package is transferred from the doffing machine to the empty tray to load the empty tray with the package, and then the loaded tray is returned to the main conveying line. When transferring yarn packages from the doffing machine to empty trays by such a procedure, the doffing machine needs to suspend the yarn package transferring operation after transferring one yarn package to an empty tray for a time in which the loaded tray is returned from the feed line to the main conveying line and the next empty tray is transferred from the main conveying line to the feed line. Thus, the previously proposed system requires much time for transferring all the yarm packages from the doffing machine to empty trays.

OBJECT AND SUMMARY OF THE INVENTION

Accordingly, it is an object of the present invention to provide a yarn package conveying system capable of curtailing time necessary for transferring yarn packages from a doffing machine to empty trays.

The present invention provides a yarn package conveying system in which a plurality of empty trays are transferred from a main conveying line conveying trays to a feed line branched off from the main conveying line, yarn packages are transferred one after another from a doffing machine to the empty trays arranged on the feed line, and the loaded trays are returned one after another to the main conveying line. This yarn package conveying system curtails time necessary for transferring yarn packages from the doffing machine to empty trays and simplifies yarn package transferring work and a tray conveying machine.

A plurality of empty trays are transferred from a main conveying line to a feed line branched off from the main conveying line, yarn packages are transferred one after another to the empty trays, and then the loaded trays are returned to the main conveying line.

DETAILED DESCRIPTION OF PREFERRED EMBODIMENT

Figure 1:
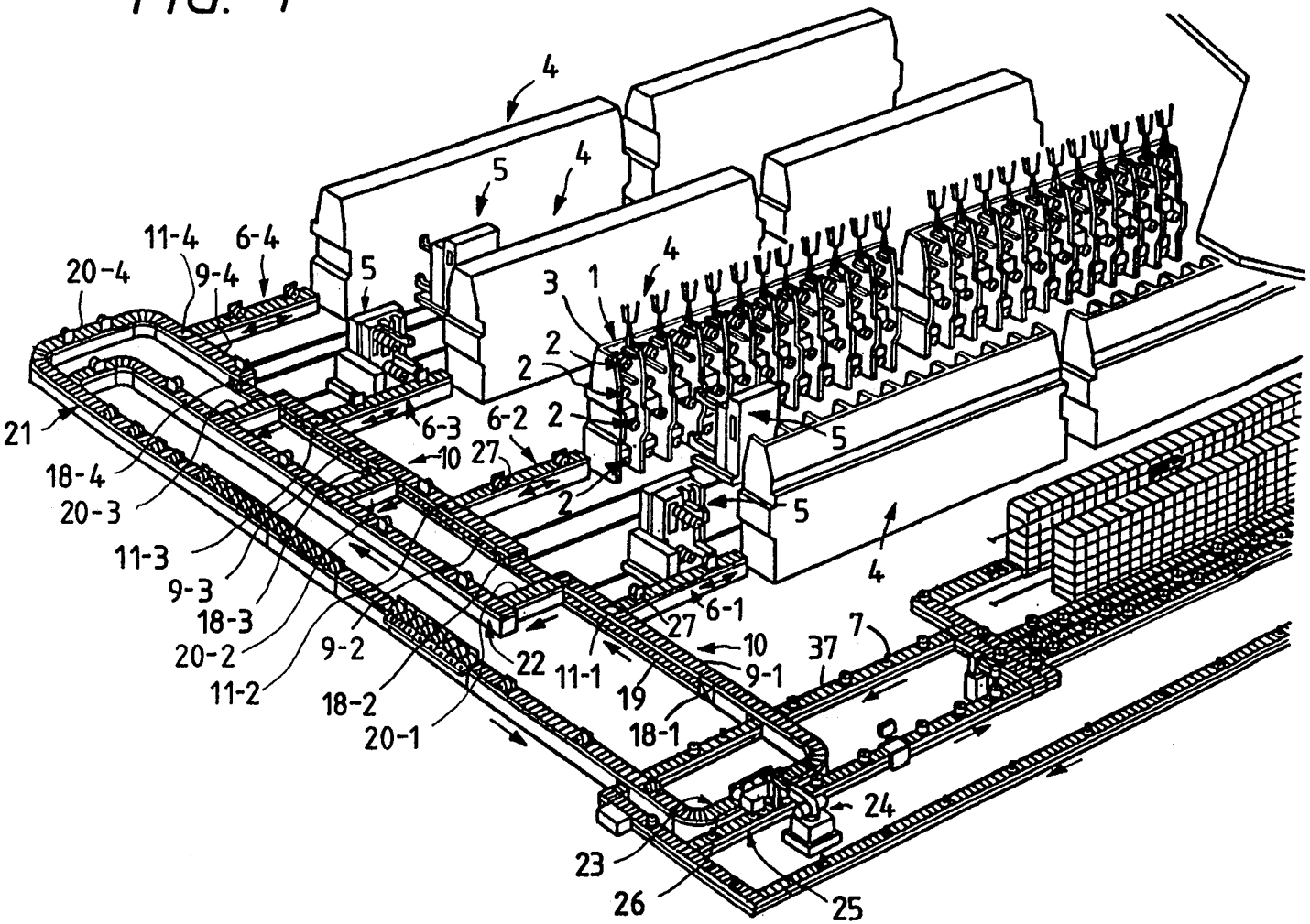
FIG. 1 is a perspective view of a yarn package conveying system in a preferred embodiment according to the present invention.
Figure 2:
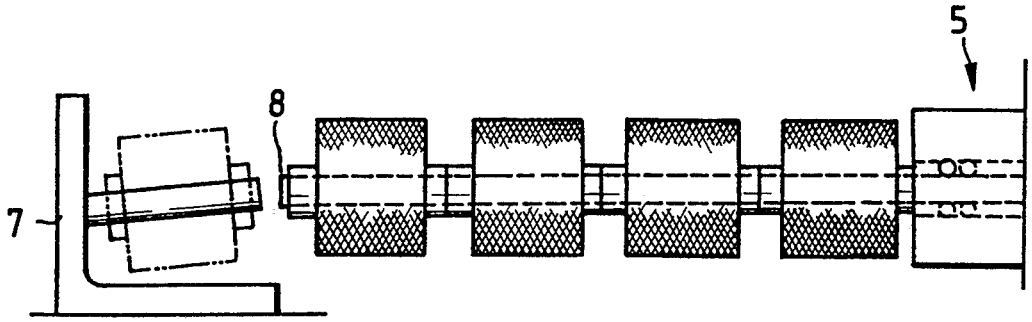
FIG. 2 is a side view of a yarn package transfer device employed in the present invention.

A yarn package conveying system in a preferred embodiment according to the present invention will be described hereinafter with reference to the accompanying drowings. As shown in FIG. 1, a spinning machine 1 is provided with a plurality of winding units 2 in a stepped arrangement for winding yarns in a plurality of yarn packages 3.

A spinning unit 4 is formed by arranging a plurality of such spinning machines 1, and a plurality of such spinning units 4 are arranged in a spinning mill. An automatic doffing machine 5 travels along the front side of each spinning unit 4. A full yarn package signal is provided when a full yarn packages are formed on one of winding unit 2 of one of the spinning machines 1 of each spinning unit 4, the automatic doffing machine 5 travels to the relevant winding unit 2, and then the automatic doffing machine 5 doffs all the plurality of full yarn packages simultaneously from the winding unit 2.

A reversible feed conveyor 6 forming a feed line is installed on one end of each spinning unit 4. The feed conveyor 6 conveys, for example, eight empty trays 7 at a time to the right, as viewed in FIG. 1, and then the automatic doffing machine 5 transfers four yarn packages supported on a peg 8 one after another to the four empty trays 7. The four yarn packages supported on the peg 8 may be transferred one after another to the empty trays 7 by any known device, such as a yarn package transfer device employing a ball-and-screw mechanism proposed by the applicant of the present application in Japanese Utility Model Laid-open (Kokai) Sho 63-142366. The automatic doffing machine 5 provides two supporting rods 8 and each of the supporting rods 8 supports four packages thereon, respectively.

A distributing accumulator roller conveyor 10, i.e., a component of a main conveying line, serving as a common conveying apparatus for the spinning units 4, consisits of upper accumulator roller conveyors 9 and lower accumulator roller conveyors 19. Each upper accumulator roller conveyor 9 is connected through a turntable 11 to the feed conveyor 6. The lower distributing accumulator roller conveyor 19 acts to be an empty tray conveying line as a bypass conveyor of the upper distributing accumulator roller conveyor 9.

Figure 3:
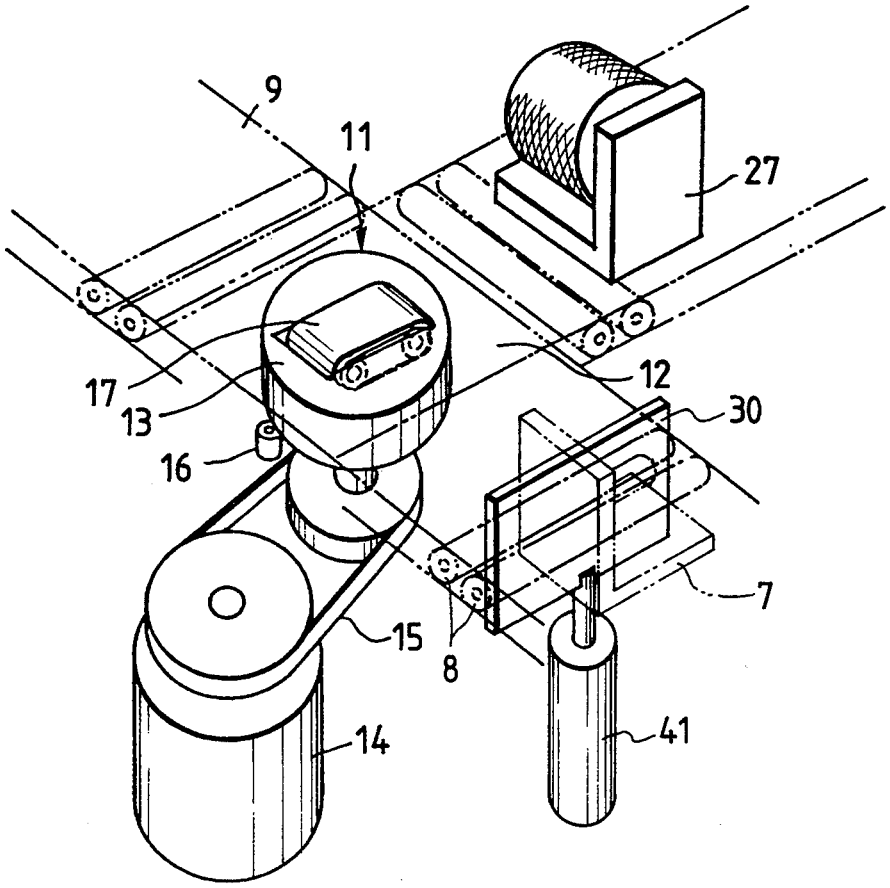
FIG. 3 is a perspective view of a turntable employed in the yarn package conveying system of the present invention.

As shown in FIG. 3, the turntable 11 comprises a frame 12, a rotary platform 13 supported for rotation in the central region of the frame 12, and a motor 14 for driving the rotary platform 13 through a belt 15. The rotary platform 13 is turned through an angle of 90° at a time. The angular position of the rotary platform 13 is detected through the detection of angle indices formed on the rotary platform 13 by a detector 16. The rotary platform 13 is provided in its central portion with a transfer conveyor 17, which is driven by a motor, not shown, held on the rotary platform 13.

Each upper accumulator roller conveyor 9 and the corresonding lower accumulator roller conveyor 19 of the distributing accumulator roller conveyor 10 are interconnected by a lift 18. The upper accumulator roller conveyors 9 are connected to a working accumulator roller conveyor 21 by a connecting conveyor 20 which is a loaded tray ejecting line. The yarn package conveying system is provided with a bypass conveyor 22 connected to the working accumulator roller conveyor 21 for bypassing the turntables 11.

Figure 5:
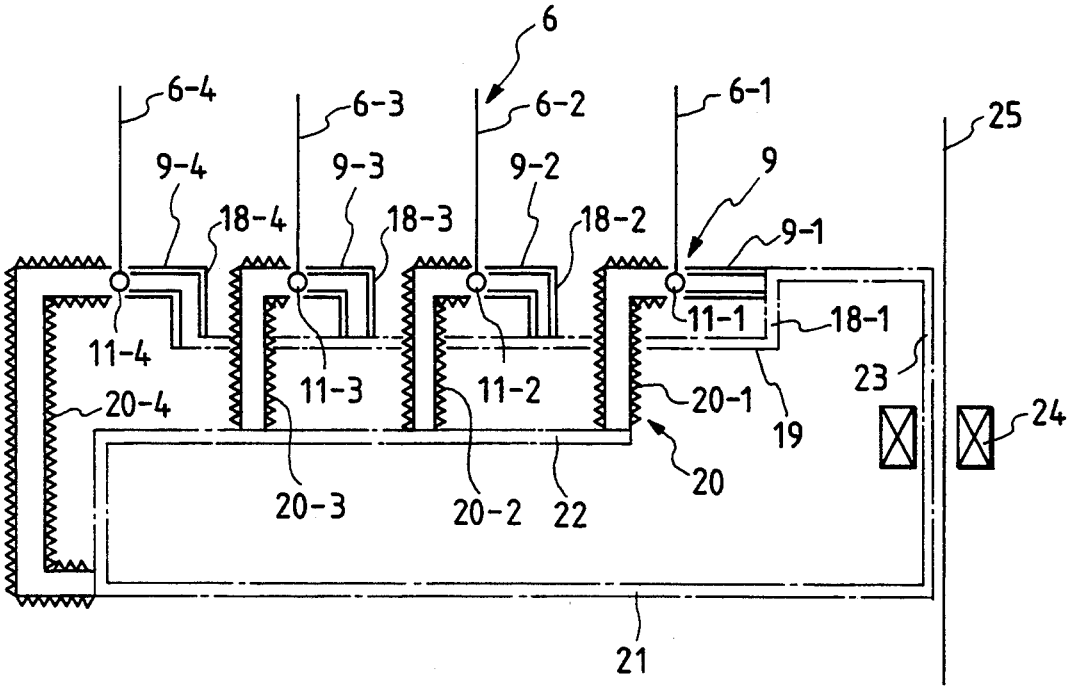
FIG. 5 is a schematic illustration showing a tray conveying line, a tray taking-in line and a tray ejecting line of the present invention.

As shown in FIG. 5, empty trays are taken in onto a plurality of yarn feeding conveyors 6-1, 6-2, 6-3, and 6-4, which are consisting of a plurality of yarn feed lines for transferring packages on the trays from a winding machine, from the upper distributing accumulator roller conveyors 9-1, 9-2, 9-3, and 9-4 extending between the turntables 11-1, 11-2, 11-3, and 11-4 consisting of the empty tray taking-in line and the lifts at the upper stream side, 18-1, 18-2, 18-3 and 18-4.

While, the packages doffed from the winding machine are ejected to the connecting conveyors 20-1, 20-2, 20-3, and 20-4 consisting of loaded tray ejecting line at the down stream side of the turntables 11-1, 11-2, 11-3, and 11-4 through a plurality of yarn feeding conveyors 6-1, 6-2, 6-3, and 6-4 consisting of a plurality of yarn feed lines for transferring packages onto trays.

The lower distributing accumulator roller conveyor 19 connected by the lift 18 consists of an empty tray conveying line and is connected to the upper distributing accmulator roller conveyors 9-1, 9-2, 9-3, and 9-4 as to be the empty tray taking in line. When the predetermined number of empty trays have been already stored on the upper distributing accumulator roller conveyors 9-1, 9-2, 9-3, and 9-4, empty trays are transferred to the lower accumulator roller conveyor 19 as to be the empty tray conveying line by the lifts 18-1, 18-2, 18-3, and 18-4 one after another.

The connecting conveyor 20 as to be the loaded tray ejecting line is connected to the upper distributing accumulator roller conveyor 9, the working accumulator roller conveyor 21, and the bypass conveyor 22. Each of the connecting conveyors 20-1, 20-2, 20-3, and 20-4 is connected to the upper distributing accumulator roller conveyors 9-1, 9-2, 9-3 and 9-4, respectively. The working accumulator roller conveyor 21 and the bypass conveyor 22 consist of the loaded tray conveying line for conveying loaded trays which have been ejected. A plate-like stopper 30 which is able to protrude from the clearance of rollers 8 toward the upper portion of the rollers 8 is provided and is driven upward and downward by means of an air cylinder 41.

A transfer device 24 is disposed beside a connecting conveyor 23 connecting the working accumulator roller conveyor 21 to the distributing accumulator roller conveyor 10. A storing conveyor 25 is extended in parallel to the connecting conveyor 23 and trays 26 are placed on the storing conveyor 25 with their pegs in a vertical position. The transfer device 24 puts yarn packages on the trays 26.

In operation, trays 27 respectively supporting yarn packages on their pegs in a horizontal position are transferred one after another from the feed conveyor 6 to the turntable 11. The tray 27 transfered from the feed conveyor 6 onto the rotary platform 13 is placed in the central portion of the rotary platform 13 by the transfer conveyor 17, the rotary platform 13 is turned through an angle of 90° by the motor 14. The feed conveyors 6-1 and 6-3 are turned clockwise and the feed conveyors 6-2 and 6-4 are turned counterclockwise as viewed in FIG. 3. The angular position of the rotary platform 13 is detected by the detector 16. The detector 16 povides a signal when the rotary platform 13 is turned through an angle of 90° to stop the motor 14.

Then, the transfer conveyor 17 is actuated to transfer the tray from the rotary platform 13 to the upper accumulator roller conveyor 9. The same procedure is repeated to transfer the loaded trays one after another from the feed conveyor 6 to the upper accumulator roller conveyor 9. The loaded trays are conveyed by the bypass conveyor 22 or the like to the working accumulator roller conveyor 21. A stopper 30 is projected from the working accumulator roller conveyor 21 to accumulate the trays succuessively conveyed to the working accumulator roller conveyor 21 temporarily on the working accumulator roller conveyor 21. When eight trays are accumulated on the working acumulator roller conveyor 21, the stopper 30 is retracted to release the eight trays for conveyance.

A device 28 for defective yarns forming the surface of the packages and bunches of yarns being removed is provided and the yarn packages are inspected visually on the working accumulator roller conveyor 21. Then, the yarn packages are transferred from the trays 27 to trays 26 having vertical pegs on the connecting conveyor 23 by the transfer device 24, and the unloaded trays 27, i.e., empty trays, are carried away.

The empty trays are conveyed again to the upper accumulator roller conveyor 9, a stopper 30 projecting from the upper accumulator roller conveyor 9 stops the empty trays to accumulate eight empty trays on the upper accumulator roller conveyor 9. The eight empty trays are conveyed to the feed conveyor 6 for the spinning machine which provided an empty tray request signal. When sending the eight empty trays to the feed conveyor 6-1,the eight empty trays are conveyed over the lift 18-1, the orientation of the eight empty trays is changed through an angle of 90° by the turntable 11, and then the eight empty trays are trasferred one after another to the feed conveyor 6-1. When sending the eight empty trays to the feed conveyor 6-2, the eight empty trays are trasferred one after another to the lower accumulator roller conveyor 19 by the lift 18-1, the eight empty trays are transferred from the lower accumulator roller conveyor 19 to the upper accumulator roller conveyor 9 by the lift 18-2, the orientation of the eight empty trays is changed through an angle of 90° by the turntable 11-2, and then the eight empty trays are transferred to the feed conveyor 6-2. Similarly, the eight empty trays are sent to the feed conveyor 6-3 by the lift 18-3 and the turntable 11-3, the eight empty trays are sent to the feed conveyor 6-4 by the lift 18-4 and the turntable 11-4.

When eight empty trays are not accumulated on the upper accumulator roller conveyor 9-1 extending before the feed conveyor 6-1, trays pass through the lift 18-1 and are stoppd by the stopper 30 until eight empty trays are stored on the upper accumulator roller conveyor 9-1. When eight empty trays are accumulated on the upper accumulator roller conveyor 9-1, trays are sent through the lifts 18-1 and 18-2 to the upper accumulator roller conveyor 9-2 extending before the next feed conveyor 6-2. If eight empty trays are accumulated also on the upper accumulator roller conveyor 9-2, trays are sent sequentially to the upper accumulator roller conveyors 9-3 and 9-4. When eight empty trays are stored on each of the upper distributing accumulator roller conveyors 9-1, 9-2, 9-3, and 9-4, empty trays are stored on the lower distributing accumulator roller conveyor 19.

Operation for transferring yarn packages from the doffing machine to trays supported on the feed conveyor 6-1 will be described by way of example with reference to FIGS. 4*a*, 4*b* and 4*c*. In a state shown in FIG. 4*a*, loaded trays loaded with yarn packages on the feed conveyor 6-1 has been delivered onto the upper accumulator roller conveyor 9-1 and the feed conveyor 6-1 is empty. Eight empty trays are stopped by the stopper 30 and stored on the upper accumulator roller conveyor 9-1.

Figure 4A:
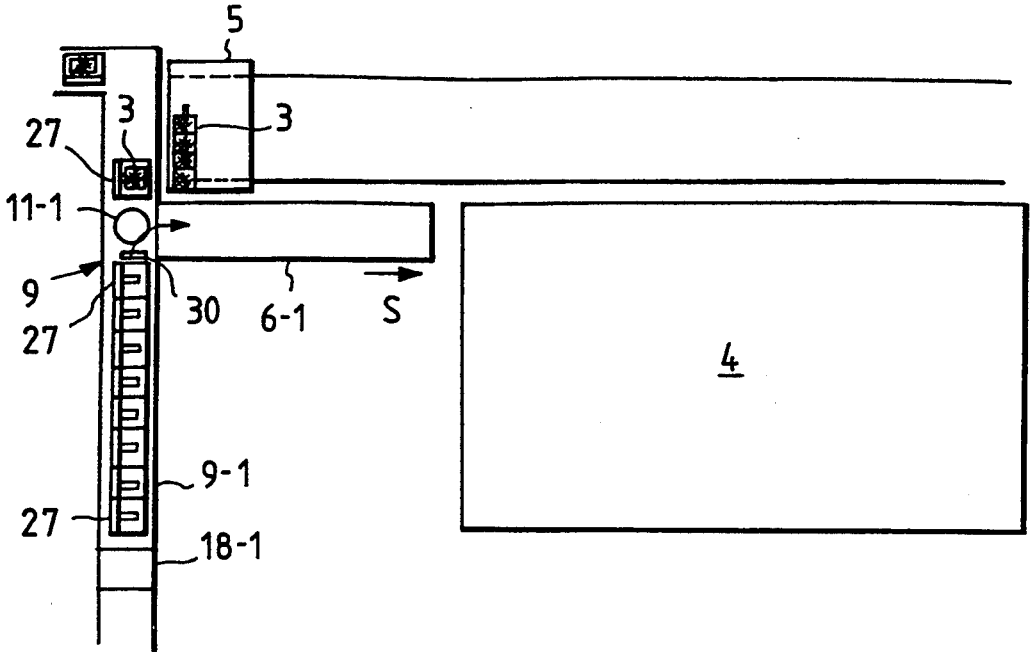
FIG. 4*a* is a plan view of a portion of the yarn package conveying system of the present invention, in which loaded trays loaded with yarn packages on a feed conveyor and empty trays are stopped by a stopper and stored on the upper accumulator roller conveyor.

In a state shown in FIG. 4*a*, the stopper 30 is retracted and the eight empty trays are transferred simultaneously from the upper accumulator roller conveyor 9-1 to the feed conveyor 6-1, driving the feed conveyor 6-1 for conveyance in the direction of the arrow S to convey the empty trays toward the spinning unit 4. The feed conveyor 6-1 has a length exactly enough to store eight trays.

Figure 4B:
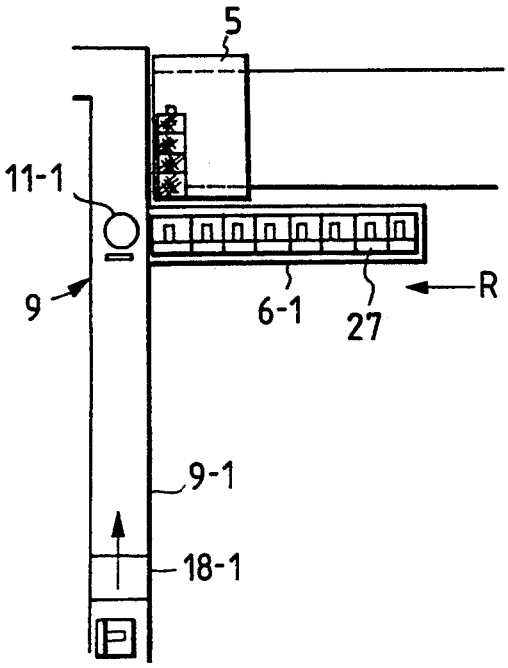
FIG. 4*b* is a plan view similar to FIG. 4*a*, in which empty trays are delivered to the feed conveyor.
Figure 4C:
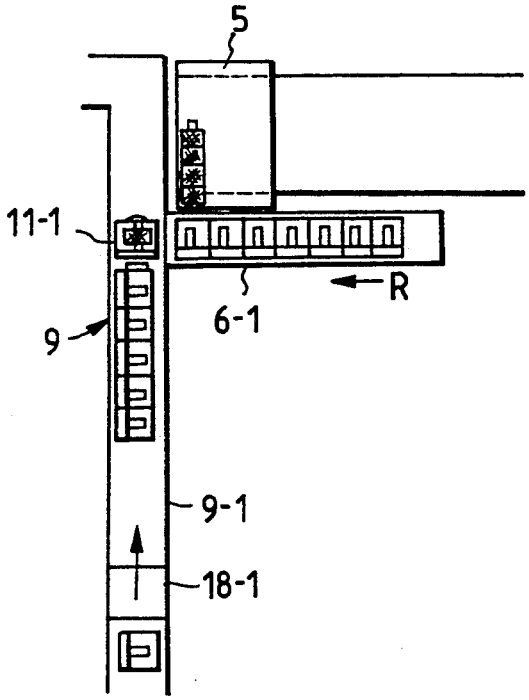
FIG. 4*c* is a plan view similar to FIG. 1, in which loaded trays are being transferred from the feed conveyor to the upper accumulator roller conveyor.

In a state shown in FIG. 4*b*, the doffing machine 5 is located at a position corresponding to a loading position at the entrance of the feed conveyor 6-1 or the same is moved to the position corresponding to the loading position at entrance of the feed conveyor 6-1 after the empty trays has been transferred to the feed conveyor 6-1. Then, a yarn package is put on the first empty tray at the loading position at the entrance of the feed conveyor 6-1, the feed conveyor 6-1 is driven for conveyance by a distance corresponding to one tray in the direction of the arrow R to deliver the loaded tray onto the upper accumulator roller conveyor 9-1 and to shift the second empty tray to the loading position (as shown in FIG. 4*c*). Thus, the doffing machine 5 is held at the position corresponding to the entrance of the feed conveyor 6-1, the feed conveyor 6-1 is driven intermittently to transfer yarn packages one after another to the empty trays, and the loaded trays are delivered sequentially onto the upper accumulator roller conveyor 9-1. Meanwhile empty trays are stored successively on the upper accumulator roller conveyor 9-1 to establish the state shown in FIG. 4*a* again.

The posture of trays carried on each feed conveyors 6-1, 6-2, 6-3, and 6-4 are at random on each feed conveyors. However, all trays are faced to a certain direction on the working accumulator roller conveyor 21 for processing visual inspection of packages since each tray is directed to a certain direction by the turntables 11-1, 11-2, 11-3 and 11-4. So, it is not necessary to provide another posture converting device prior to the inspecting device.

The package conveying system of the present invention comprises a plurality of yarn feed lines 6-1, 6-2, 6-3, and 6-4 for transferring packages onto trays from the winding machine, the empty tray conveying line 23, and the loaded tray conveying lines 21 and 22 as shown in FIG. 5. Each yarn feed line is connected to the empty tray taking in lines 9-1, 18-2, 9-2, 18-3, 9-3, 18-4, and 9-4, which are connected to the empty tray conveying line and loaded tray conveying line, respectively and are specified to each of them, and the loaded tray ejecting lines 20-1, 20-2, 20-3 and 20-4. The taking in operation of empty trays from the empty tray conveying line to the each yarn feed line and taking out operation of loaded tray from each yarn feed line to the loaded tray conveying line are processed by the empty tray taking in line specified to each yarn feed line and the loaded tray ejecting line, so that empty trays and loaded trays are never mixed and it is not necessary to discriminate the empty trays and loaded trays in a way of the conveyance.

Furthermore, since a requested number of trays are stored on the empty tray taking in line at the upstream side of the each yarn feed line, the empty tray can be immediately supplied to each yarn feed line on request, the time for conveying trays can curtail, and conveying efficiency is improved because many trays are conveyed at a time. The empty tray taking in line and empty tray conveying line are constructed to be up and down stages and trays which are over the requested number of trays are distributed to the empty tray conveying line disposed under the empty tray taking in line, so that the space for conveyance may be decreased, and the tray conveying system is simplified and may be controlled easily.

According to the present invention, yarn packages wound by the plurality of winding units are doffed simultaneously by the doffing machine, and then the yarn packages are transferred directly from the doffing machine to trays one after another. Therefore, the yarn packages need not by transferred indirectly from the doffing machine through a peg to trays, which is necessary in the prior art yarn package conveying system. Thus, the present invention simplifies the work for transferring yarn packages from the doffing machine to trays. Since the prior art yarn package coveying system puts yarn packages upside down on trays, the yarn packages need to be transferred again to other trays to invert the yarn packages for the following processes. The yarn package conveying system of the present invention eliminates the work for inverting yarn packages and simplifies yarn package conveying operation. Since a plurality of empty trays are supplied simultaneously to the feed line, yarn packages are transferred one after another from the doffing machine to the empty trays, and then the loaded trays are returned to the main conveying line, the yarn package conveying system curtails time necessary for transferring yarn packages from the doffing machine to the empty trays.

The reversible feed line is extended inconnection with the winding units, a plurality of trays are arranged on the feed line and the yarn packages doffed from the winding units by the automatic doffing machine can be transferred one after another from the automatic doffing machine to the trays without moving the large automatic doffing machine.

What is claimed is:

1. A package conveying system, comprising:

a main line for conveying trays, a feed line branched from the main line, the feed line having a first end adjacent the main line and a second end, means for transferring a plurality of empty trays substantially simultaneously from the main line to the first end of the feed line, means for transferring a yarn package from a doffing machine to an empty tray at the first end of the feed line to thereby produce a loaded tray at the first end of the feed line, and means for individually transferring each loaded tray at the first end of the feed line from the first end of the feed line to the main line.

2. The system of claim 1, wherein the main line comprises a stopper for storing a plurality of empty trays on the main line while each loaded tray at the first end of the feed line is transferred from the first end of the feed line to the main Line.

3. The system of claim 1, comprising a turntable for connecting the main line and the first end of the feed line.

4. A package conveying system, comprising:

a main line for conveying trays, a plurality of feed lines branched from the main line, at least one of the plurality of feed lines having a first end adjacent the main line and a second end, means for transferring a plurality of empty trays substantially simultaneously from the main line to the first end of the feed line, means for transferring a yarn package from a doffing machine to an empty tray at the first end of the feed line to thereby produce a loaded tray at the first end of the feed line, and means for individually transferring each loaded tray at the first end of the feed line from the first end of the feed line to the main line, and wherein the main line comprises:

at least one upper accumulator roller conveyor, at least one lower accumulator roller conveyor, and a lift for connecting the upper accumulator roller conveyor and the lower accumulator roller conveyor.

* * * * *